114-253 SR
2/7/78 XR 4,072,122

United States Patent [19]

Balston

[11] 4,072,122

[45] Feb. 7, 1978

[54] MOORING AND RELEASE DEVICE

[75] Inventor: John C. Balston, San Rafael, Calif.

[73] Assignee: The Rucker Company, Oakland, Calif.

[21] Appl. No.: 749,720

[22] Filed: Dec. 13, 1976

[51] Int. Cl.[2] ..... B63B 21/06; B63B 21/56

[52] U.S. Cl. ..... 114/230; 114/217; 114/247; 114/253; 254/172

[58] Field of Search ..... 114/230, 247, 249, 251, 114/252, 253, 254, 217, 214, 213, 218; 254/172, 150 R; 24/115 F

[56] References Cited

U.S. PATENT DOCUMENTS

| | | | |
|---|---|---|---|
| 1,297,418 | 3/1919 | Tarrant | 114/252 |
| 3,645,225 | 2/1972 | Lunde | 114/251 |
| 3,812,811 | 5/1974 | Rodriguez | 114/218 |

*Primary Examiner*—Barry L. Kelmachter
*Attorney, Agent, or Firm*—Lothrop & West

[57] ABSTRACT

A hydro-pneumatic device secures and releases a mooring or towing hawser to a vessel. A carriage reciprocates on a frame on the vessel and moves a bollard between one position securing a hawser to the towing or moored vessel and another position releasing the hawser. Movement of the carriage on the frame is accompanied by movement of a piston in a cylinder on the frame, the piston being connected to the carriage by a chain trained around a sprocket on the piston rod. A combination of liquid and gaseous fluid systems with various manual and automatic controls is connected to the cylinder and normally allows the piston to oscillate about a chosen average position. The fluid system by manual or automatic control lets the carriage move to a predetermined, extreme position on the frame. In such position the carriage actuates the bollard to release position, freeing the line. The carriage can be locked to the frame in the extreme position. Various safety and control devices are provided for the operation of the fluid systems.

7 Claims, 9 Drawing Figures

MOORING AND RELEASE DEVICE

CROSS-REFERENCES TO RELATED APPLICATIONS, IF ANY

None, although U.S. Pat. No. 3,973,511 assigned to the assignee hereof is of interest.

BRIEF SUMMARY OF THE INVENTION

A carriage is movable on a frame on a vessel and is accompanied in its movement by motion of a piston in a cylinder. The carriage carries on its upper portion a bollard movable between a secured position engaging and holding a line or hawser extending to another vessel or to a mooring, and another, released position in which the line is let go from the mooring or so that the vessels are separated. The movement of the piston in the cylinder is controlled and responded to by fluid systems including a body of trapped gas subjected to pressure of liquid in the cylinder, there being various controls for regulating and operating the fluid systems. While the carriage and piston normally operate in a selected average position, there can be, upon occasion, a movement of the carriage into a predetermined, extreme position on the frame. The carriage can be locked in that extreme position. There is manual and automatic release so the bollard can move from its secured position to its released position. The device affords an appropriate cushion for a line or hawser under strain and manually and automatically affords a quick release of the line in an emergency.

DETAILED DESCRIPTION

Figure 2:
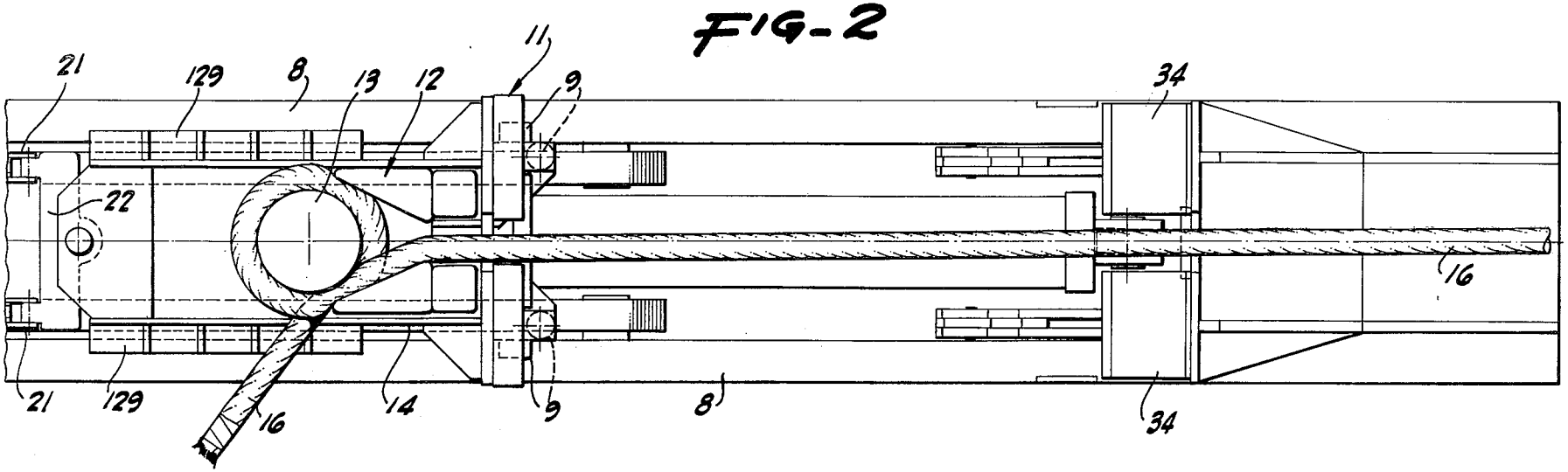
FIG. 2 is a view of a portion of the apparatus, the view being taken as indicated by the line 2—2 of FIG. 1.

In some marine operations, particularly those involving the towing of one vessel by another and particularly under rough conditions, there is often difficulty because of the operation of the sea and the wind on the vessles, tending to vary the distance between them and correspondingly the slack and strain on the connecting tow line. The conditions sometimes are rough enough; for example, in connection with some of the supply boat operations for oil drilling rigs in the North Sea, that is is necessary quickly to cast off the towed vessel from the towing tug or work boat. This is now often accomplished by having a man stand by with an ax and upon command severing the tow line. This is an imprecise and difficult operation and is not always carried out with the desired success.

It is therefore an object of the invention to provide a mooring and releasing device effective to afford a cushioned strain on the line between the vessels during most ordinary operations and upon occasion to afford a quick release of the line from the towing vessel so that the line is instantly freed or released and without damage to the line or to either vessel.

Another object of the invention is in general to provide an improved mooring and releasing device that can find application in numerous different marine towing and mooring environments to provide assured and quick handling of the line.

The device can be used for stationary mooring, as to a dock, but since the present prime application is in towing, that environment is described.

In a customary installation, the towing vessel or tug or leading boat has provided on each after quarter an individual device pursuant to the present disclosure. A bridle, consisting of two lines, one end of each connected to its respective bollard and the other ends joined together to a towing hawser, is connected between the tug and the tow. Since both devices are the same and operate in the same fashion, there is reference herein to a single such structure and a single line. For example, as shown particularly in FIG. 1, the deck 6 of the towing vessel carries a frame 7 comprising the customary beams, angles, shapes, braces and the like extending longitudinally along the deck generally parallel to the keel of the tug.

The upper portion of the frame is provided with rails 8 symmetrical about a center line, as is most of the structure. The rails support the wheels 9 of a carriage 11 adapted to reciprocate longitudinally on the frame. The carriage is particularly equipped with a releasing bollard 12 of the same type shown in U.S. Pat. No. 3,973,511, noted above. This bollard has a movable drum 13 connected to the bollard frame 14 by a cross pivot shaft 15. The bollard drum is normally in the position shown in FIG. 6 with its axis vertical and in such position receives a line 16, turned about the bollard drum and clamped or secured in position. Upon occasion the bollard drum can be released and move from its secure position with its axis vertical into a cast-off position, pivoting about the shaft 15 and moving its axis into an inclined position so that the line 16 under tension can readily pull away from the previous bollard restraint and become automatically free. The bollard drum, when the line has been freed, drops back into its initial position by gravity.

Figure 1:
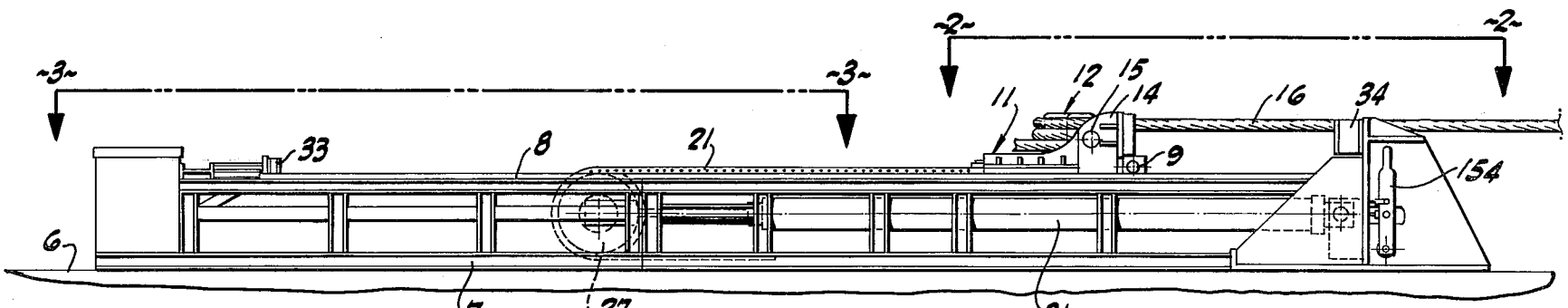
FIG. 1 is a side elevation of the mooring and release device, constructed pursuant to the invention, as it appears on the afterdeck of a vessel and showing a hawser or line in position.

The carriage, carrying the bollard with it and moving to and fro on the tracks, similarly moves chains 21 equalized by a whiffletree connector 22. The chains are trained around a pair of sprockets 23 and are joined to anchors 24 on the base of the frame 7. The sprockets 23 are at the ends of a cross shaft 26 journalled in a yoke 27 (FIG. 3) at the outboard end of a piston rod 28. The piston rod at its inboard end is fast to a piston 29 (FIG. 9) within a cylinder 31 secured in a mounting structure 32 forming part of the frame 7. In this way tension on the carriage tending to pull it to the right in FIG. 1 is effective to move the piston 29 half the distance to the right in that figure. Similarly, pressure on the piston rod tends to operate the chains to pull the carriage twice the distance to the left in that figure.

It is normally desired to have the carriage positioned in an intermediate or average, central position as the towing is going on, and correspondingly the piston in the cylinder will likewise normally travel in about the center of its total reciprocation. The total carriage travel is marked or limited at both ends by resilient bumpers 33 and 34, preferably polyurethane blocks secured to the frame 7.

To provide for carriage movement and control, there is provided in connection with the cylinder a fluid responsive and regulating system, the fluid including both liquid and gas constituents.

The gas system, which may involve air, or preferably nitrogen, as the operating fluid, is originally supplied from supply bottles 41 (FIG. 9) connected by lines 42 to a supply pipe 43 equipped with a shutoff valve 44. Initially the bottles 41 are put into position and the valve 44 is opened until the system is charged, whereupon the valve 44 is closed and the bottles 41 can be removed and replaced. Gas flow from the valve 44 in one direction is through a duct 46 and through a pressure regulating valve 47 and a check valve 48 into a line 49 leading to a supply line 51. This is connected to a manifold 52 joined to a plurality of gas storage bottles 53 so that a substantial reservoir of operating gas is available whether or not the supply bottles 41 are connected. A gauge 54 joined to the pipe 49 indicates the momentary pressure in the manifold 52 and the supply line 51.

In the event there is excess pressure as shown by the gauge 54, a valve 56 can be opened to rupture a protector 57 and discharge the excess gas, under supervision, to the atmosphere. Normally, pressure in the supply line 51 is approximately 100 psi and is kept from exceeding 500 psi, as there is afforded an automatically pressure responsive relief valve 58. When the predetermined maximum pressure is exceeded, the valve 58 pops off through a check valve 59 and opens a protector 61 to discharge to the atmosphere. Although the pressure in the supply line 51 is customarily controlled by the valve 47 at about 100 psi, the relief valve 58 is set higher to exhaust only under extreme conditions. The gas in the supply line 51 flows through another local, pressure regulator 62 and a line 60 into a spring urged valve 63, having mechanical and electrical control later described, and flows at the standard pressure in the line 51 through a duct 64 into another spring urged valve 66, having mechanical and electrical control later described.

Figure 9:
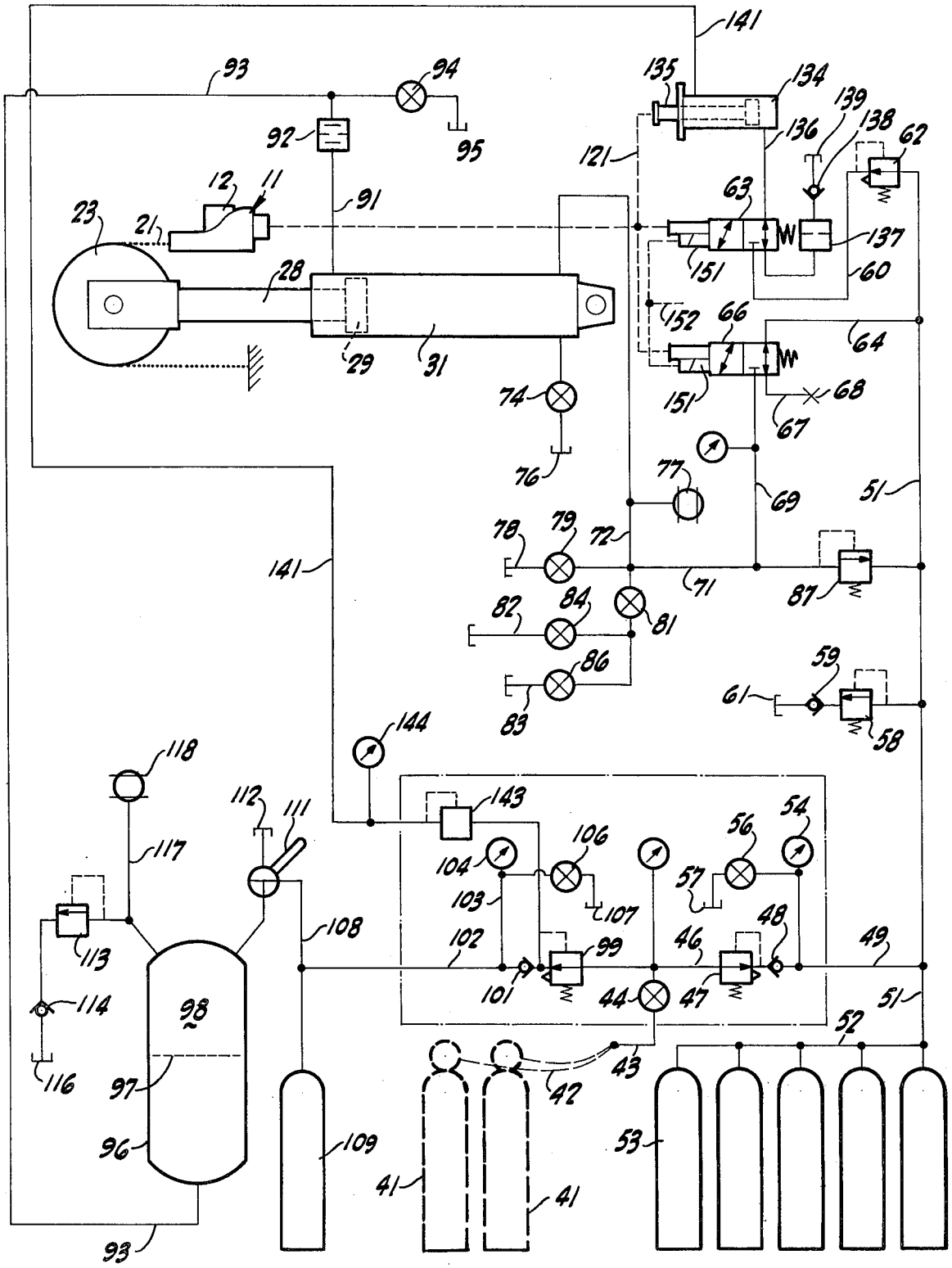
FIG. 9 is a circuit diagram of various circuit connections of the mooring and release device.

In one position of the valve 66, as shown in FIG. 9, gas from the line 64 cannot flow through the valve 66 since the outlet 67 from the valve has a blanked off or stopped end 68. When the valve 66 is shifted into a position opposite the position shown in FIG. 9, then there is gas flow from the line 64 into a line 69 joined to a distribution line 71. This has a branch 72 leading into the end of the cylinder 31 between the piston 29 and the head end so that the piston 29 is subjected to the pressure of the gas in the distributing line 71. There is provided a manual bleed valve 74 operable to discharge through a protector 76 liquid which has seeped by the piston 29 from the rod end of the cylinder. The valve 74 is normally closed so that movement of the piston 29 alternately compresses and expands gas within the head end of the cylinder and so varies the pressure in the branch 72. If the branch pressure should by any chance become excessive, there is provided a rupture disc 77 to release the excess pressure.

Normally, the pressure fluctuates in the line 72 with the piston movement, but since the small volume within the head end of the cylinder would produce excessive fluctuations, there is connected with the branch 72 a first chamber 78 made by a capped pipe and communicating with the branch through a manual valve 79 so that the volume of the chamber 78 can be added to that of the cylinder. In addition, if desired, a manual valve 81 can likewise be opened to afford access to additional volume chambers 82 and 83 individually controlled by valves 84 and 86. By manipulating the various valves 79, 81, 84 and 86, the volume of the cylinder can be restricted to the minimum amount or the connected volume can be increased in appropriate increments by employing all or selected one of the various chambers 78, 82 and 83, and so regulating the piston stroke for the individual connected load.

During the reciprocation of the piston in the cylinder, it may be that at some times the pressure in the branch 72 and the line 71 is somewhat greater than the maximum allowable. In this event, there may be gas released from the cylinder system to the line 51 in that the line 71 contains a pressure relief valve 87. The normal range of pressure within the cylinder can be kept below, say, approximately 2600 psi maximum, for if such maximum is exceeded, then the pressure relief valve 87 opens and there is backflow of gas for storage in the bottles 53. If the pressure in the line 51 tends to be in excess of, say, 500 psi, then excess gas is eliminated to the atmosphere through the pressure relief valve 58.

In the cylinder 31 on the other or rod side of the piston 29, the arrangement of the fluid system is preferably to utilize oil in much of the connected piping.

For that reason, oil between the rod end of the cylinder and the under side of the piston 29 is carried in a conduit 91 through an orifice mechanism 92 into a connecting line 93. This has a hand valve 94 and a protector 95 at the end. Drainage can take place through the protector 95 whenever the valve 94 is manually opened. Liquid in the line 93, such as a high grade oil, is carried into the lower end of an accumulator reservoir 96. It is desired to maintain a liquid level 97 near or at a convenient height in the reservoir, the upper portion 98 of the closed vessel 96 being occupied by gas. Conveniently the same gas that is available in the line 46 is utilized.

The line 46 is connected to a pressure regulator 99 opening through a check valve 101 into a line 102 having a branch 103 extending therefrom. The branch carries an indicating gauge 104 and is connected through a hand valve 106 to an atmospheric release having a protector 107. From the line 102 there is a branch line 108 extended to a local reserve gas bottle 109 making immediately available an adequate supply of gas with only a small loss in connecting lines. This supply is controlled by a manual valve 111.

In the position shown, the valve connects to the upper portion 98 of the accumulator reservoir and maintains the gas body therein at the desired quantity. When the handle of the valve 111 is moved into a different position, however, the line 108 is isolated and gas can be released from the volume 98 through a protector 112 to the atmosphere. The body of gas in the volume 98 is usually at a substantial and accepted pressure, but if the desired pressure is exceeded by a set amount, a relief valve 113 opens and through a check valve 114 discharges to the atmosphere through a protector 116. Furthermore, if there for any reason happens to be an extraordinarily excessive pressure within the gas chamber 98, then a line 117 carries the excess pressure gas through a rupture disc 118 to the atmosphere.

With this arrangement and with a substantially predetermined pressure range within the reservoir accumulator 96, the line 93 maintains an established pressure range within the rod end of the cylinder 31. Thus there is maintained a substantially standard load range on the chains and on the carriage 11, so that with an approximately compensating load on the tow line 16 the carriage moves back and forth well between the bumpers 33 and 34 and varying around a mid-stroke position at a cushioning rate maintaining substantially the desired tension at all times, although allowing for sufficient variation so that excessive forces are not involved in the towing operation.

Figure 6:
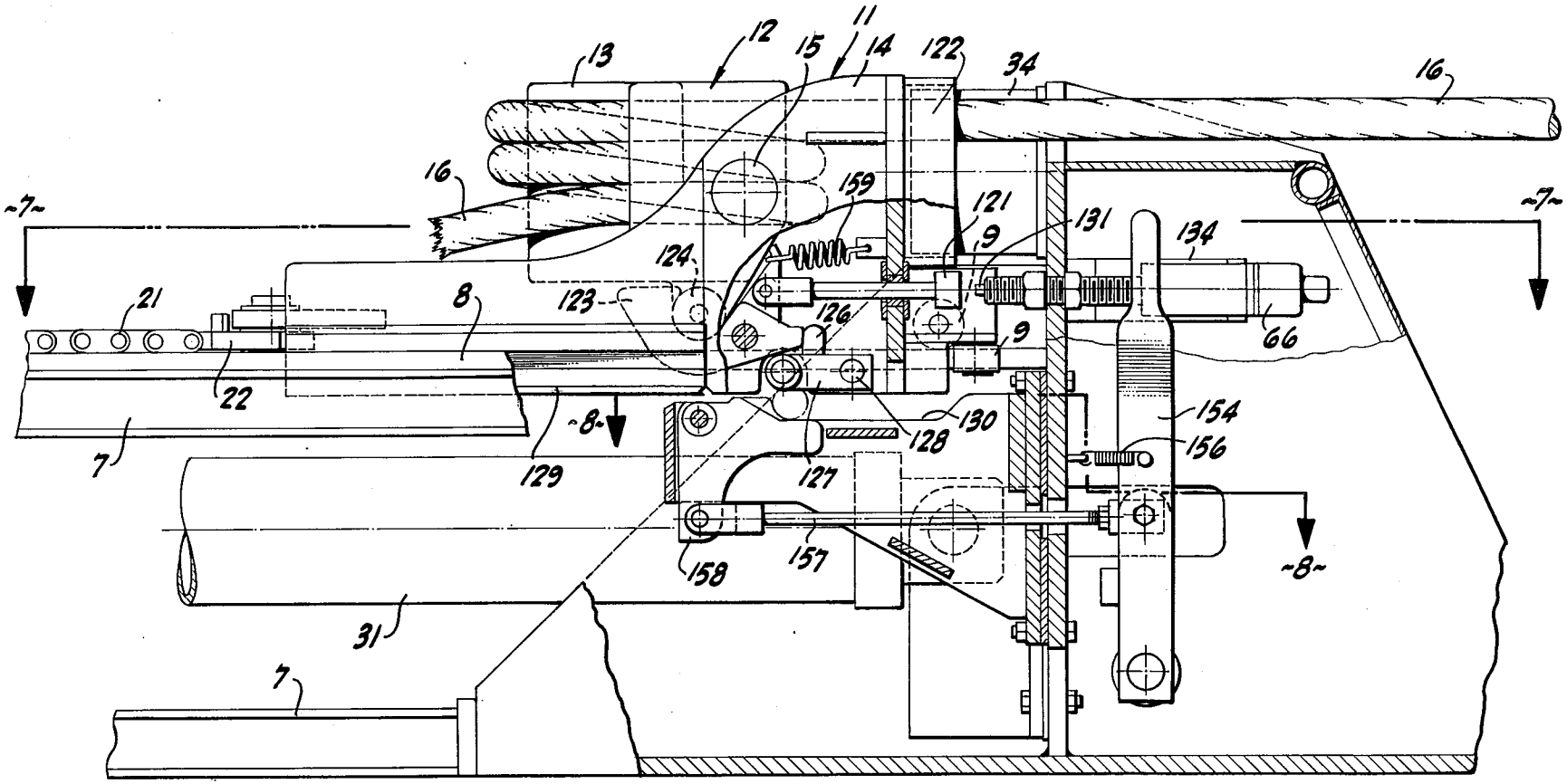
FIG. 6 is a side elevation, comparable to FIG. 4 but showing the carriage and its appurtenances near one extreme position on the frame.

Should an emergency arise at any time in the nature of an excessive load on the towing vessel, the carriage is impelled by such unusual force to travel to an extreme position, toward the right in FIGS. 6 and 9, and is pulled forcibly to deform the bumper 34. This cushions the load somewhat and permits the carriage to travel far enough into the extreme right-hand position to produce an automatic line release.

Figure 7:
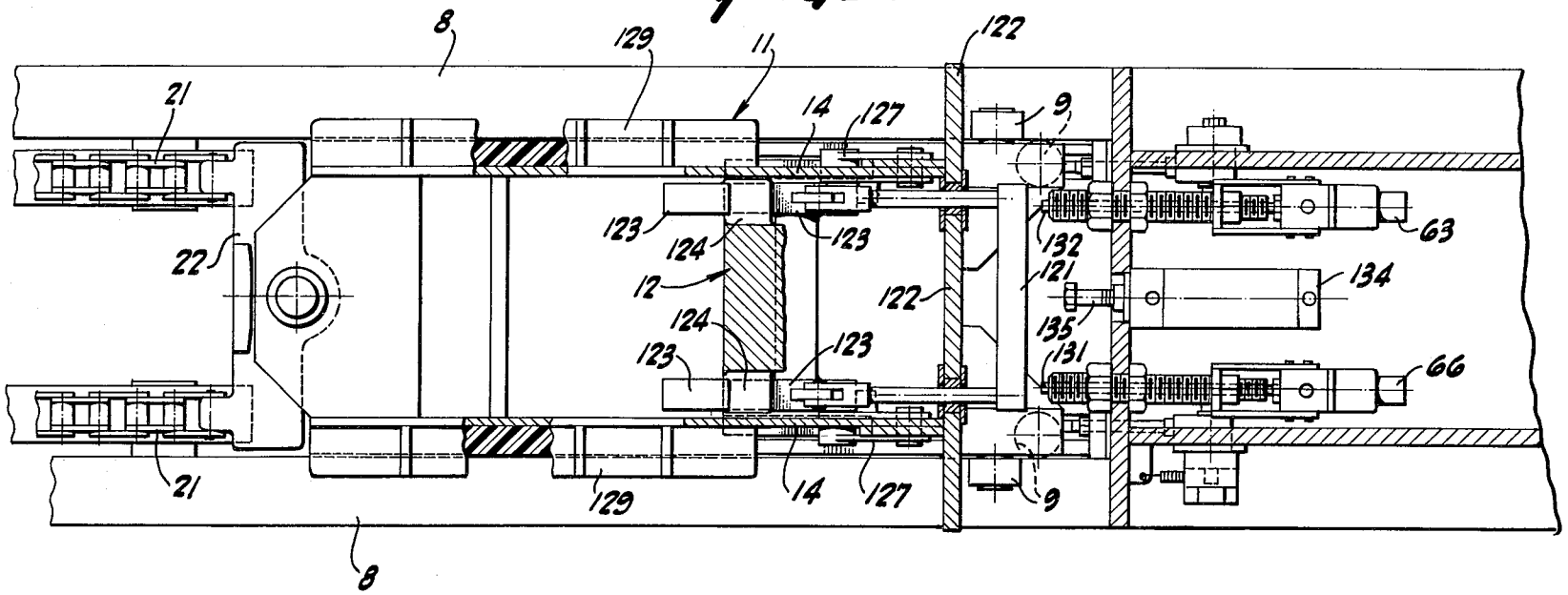
FIG. 7 is a plan of the structure shown in FIG. 6, the plane of the view being indicated by the line 7—7 of FIG. 6.
Figure 8:
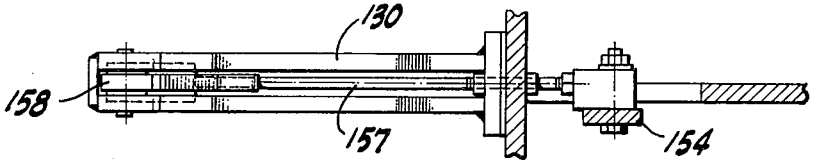
FIG. 8 is a view, the planes of which are indicated by the lines 8—8 of FIG. 6.

As the carriage moves to the end of its travel, there advances ahead of it an actuator bar 121 (FIGS. 6, 7 and 9) on the far side of a bulkhead 122 on the carriage. The bar 121 is connected to bollard release hooks 123 engaging release rollers 124 on the bollard frame 14. Normally, there is resistance to release movement of the bollard hooks. In all usual, central positions of the carriage, the hooks are kept in secure position, as shown in FIG. 6, by lugs 126 on lock levers 127 mounted on cross pivots 128 on the carriage. The levers normally run on the top of a rail 129 on the frame so that the lugs are kept in upper position. In the extreme location of the carriage, however, the rails 129 are cut away to form depressions 130. In that location the lock levers 127 can drop, moving the lugs 126 away from the ends of the bollard hooks 123. In this way there is resistance to motion of the bollard hook mechanism so that the bar 121 is kept normally in the position shown in FIG. 6.

As the carriage deforms the bumper and arrives nearly in its final position, the bar 121 comes into immediate abutment with movable valve stems 131 and 132, respectively, of the valves 66 and 63. Both of those valves are mechanically moved by the final carriage advance to shift the valves out of the positions shown in FIG. 9 into their alternate positions. When the valve 66 shifts into its alternate position, compressed gas from the cylinder chamber between the piston 29 and the cylinder head is released through the branch 72, the lines 71 and 69, the valve 66, the lines 64 and 51 to the gas bottles 53.

The valve 63 just before shifting and normally is in a position in which gas from the regulator 62 cannot flow through the valve, and gas from the closed end of a cylinder 134 is vented through a line 136 and the valve through a restricting orifice 137, thence through a check valve 138 to an atmospheric vent 139. Normally the cylinder 134 is not under pressure. But when the stem 132 is impacted by the bar 121 on the bollard carriage, the valve 63 is shifted to allow gas flow from the pressure reducer 62 and its connecting line 60 into the line 136 and the cylinder 134. The gas pressure moves the plunger 135 to project from the cylinder 134 toward the left in FIGS. 7 and 9. Such plunger movement is permitted since the rod end of the cylinder 134 is joined by a pipe 141 to the supply line 46 through a connecting line 142 having a pressure regulator 143 and a gauge 144 therein. Thus as the piston in the cylinder 134 moves to the left, there is gas flow into the line 141 as far as the pressure regulator 143, which is set at a low value; for example, 5 psi. Thus, the line 141 acts as a gas reservoir so that the low pressure gas therein is slightly compressed as gas from the line 136 at a pressure of about 100 psi projects the piston.

Figure 3:
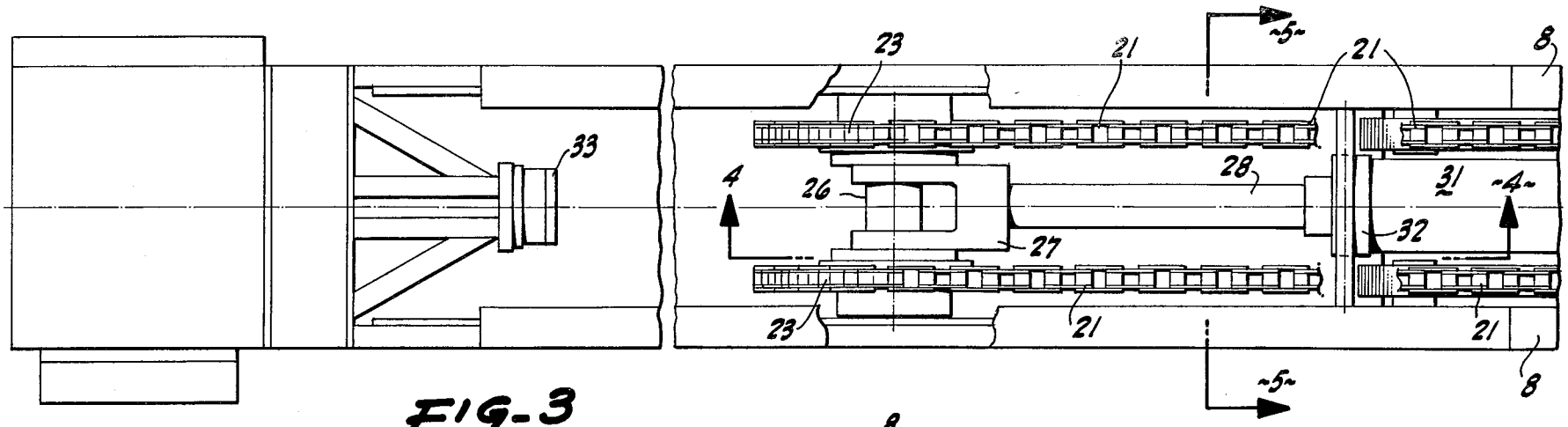
FIG. 3 is a plan view of a remaining portion of the structure of FIG. 1, the view being taken as indicated by the line 3—3 of FIG. 1.
Figure 5:
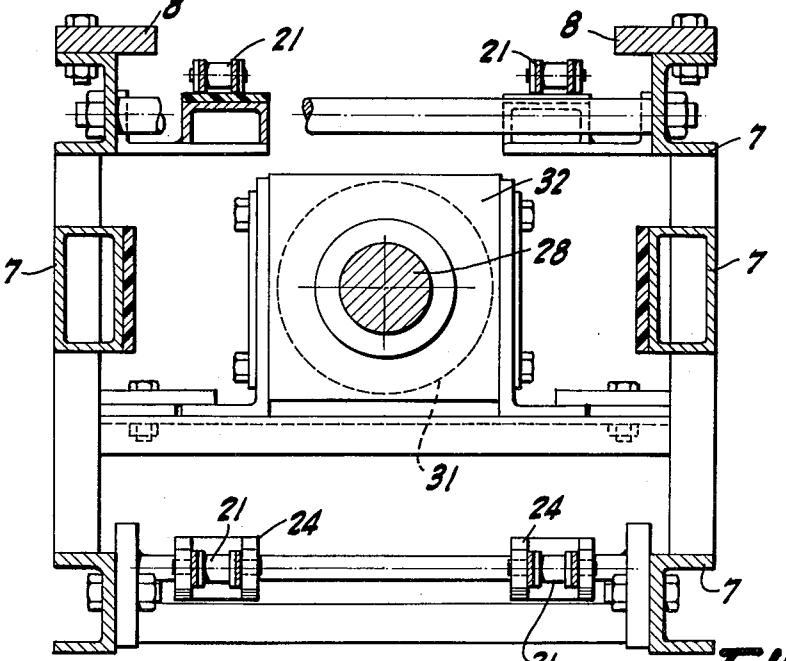
FIG. 5 is a cross-section to an enlarged scale, the plane of section being indicated by the line 5—5 of FIG. 3.
Figure 4:
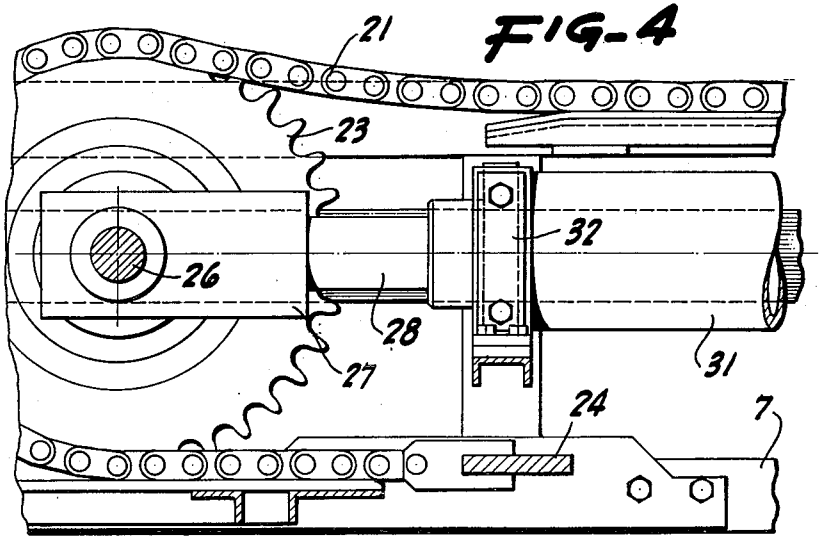
FIG. 4 is an enlarged side elevation of a portion of the structure adjacent the sprocket.

As the piston moves to the left in FIGS. 3 and 9, the adjustable plunger 135 is forced toward the left to abut and move the actuating bar 121 with sufficient force to cause rotation counterclockwise of the bollard hooks 123, thus releasing the hooks from the rollers 124 and releasing the bollard drum 13 from the carriage. The bollard drum under the continuing tension in the towing line 16 then swings upwardly to release the towing line. While this release is happening, the carriage is maintained in extreme position since the lock latch levers 127 are in a lower position in the depressions 130 of the frame. The line has thus been cast off quickly, and the prime object of the invention has been accomplished. When the actuating bar 121 moves to the left, the stems 131 and 132 of the valves follow since the valves are spring urged to the normally closed position.

In addition to mechanical actuation, the valves 63 and 66 can be actuated by electrically supplied solenoids 151 in a diagrammatically illustrated circuit 152. Preferably, control buttons (not shown) are distributed about the towing vessel at convenient points and are arranged so that the valves 63 and 66 can be actuated at any time to go into line release position for emergencies.

After a release by either means, the valves are spring restored to the positions shown in FIG. 9. After castoff, the bollard drum 13 is restored by gravity to its normal, lower position and can receive a newly positioned line 16 ready for subsequent operation. The carriage 11 is still locked in extreme position by the lock levers 127 and so does not yet move.

To release the carriage there is provided a manually operated lever 154 (FIG. 6) normally positioned by a return spring 156 and effective through rods 157 to rock restoring levers 158 upwardly. The upward motion of the levers 158 lifts the lock levers 127 into the solid line position shown in FIG. 6 and out of the depressions 130. Also, the lifted lock levers position the lugs 126 behind the bollard release hooks 123, as a return spring 159 brings the hooks around the gravity returned release rollers 124 on the bollard 12 and also returns the actuator bar 121 to its original position. These mechanical parts are then ready for another release operation.

When the valve 63 is back in its normal position, the closed end of the cylinder 134 is vented to atmosphere, so that the low gas pressure in the line 141 restores the plunger 135 to its retracted position. Just before the valve 66 is moved back into its normal position, pressure from the line 51 and the line 64 is exerted through the valve 66, the lines 69, 71 and 72 on the piston 29 to move toward the rod end of the cylinder and tension the line 16. There is an attendant movement, toward the left in FIGS. 6 and 9, of the carriage 11 and of the bollard frame 14. The manually lifted lock levers 127 are thus moved forwardly from the depressions 130 onto the rails 129 again, and the manual lever 154 can be released to return to its usual spring-maintained position. The valve 66 is restored to its normal position, as shown in FIG. 9, by deenergization of the solenoid 151 as soon as the bollard has reached the end of its full stroke, thus trapping the full volume of precharge gas in the blind end of the cylinder 31. The system is then back to original condition ready for normal tension operation and release either automatically or by electric control.

I claim:

1. A mooring and release device comprising a frame, a carriage movable upon said frame, means involving fluid flow for affording resistance to movement of said carriage into a predetermined position on said frame, means for controlling said fluid flow to reduce said resistance, means on said carriage for mooring a line, means for actuating said mooring means to release said line, means responsive to the presence of said carriage in said predetermined position for operating said actuating means, and means for locking said carriage to said frame in said predetermined position.

2. A device as in claim 1 in which said means affording resistance includes a generally closed vessel adapted to contain entrapped gas and a variable amount of liquid.

3. A device as in claim 1 in which said frame includes rails, a sprocket journalled on said frame, said carriage running on said rails, said means for affording resistance including a piston and cylinder disposed on said frame, and a chain trained over said sprocket interconnecting said piston and said carriage.

4. A mooring and release device comprising a frame, rails on said frame, a carriage supported on said rails for movement relative to said frame into and out of a predetermined location adjacent an end of said rails, a cylinder mounted on said frame, a piston and piston rod reciprocable in said cylinder, a sprocket, means for journalling said sprocket on said frame, a chain trained around said sprocket and connected to said piston rod and to said carriage, a bollard, means for mounting said bollard on said carriage for movement between a line mooring position and a line releasing position, means for holding said bollard in said line mooring position, means effective in said predetermined location for overcoming said holding means, means for entrapping gas in said cylinder on one side of said piston subject to gas compression as said carriage moves into said predetermined location, and means operated by said carriage in moving into said predetermined location for releasing said gas from said cylinder.

5. A device as in claim 4 including means for subjecting the other side of said piston to liquid under pressure.

6. A device as in claim 4 including means for locking said carriage to said frame in said predetermined location.

7. A device as in claim 4 in which said rails extend horizontally and said bollard in said mooring position extends substantially vertically upward from the top of said carriage.

* * * * *